US005441266A

United States Patent [19]

Cedrone

[11] Patent Number: 5,441,266

[45] Date of Patent: Aug. 15, 1995

[54] SYSTEM FOR GOLF PUTTING

[76] Inventor: Leonard Cedrone, 40 Baxter St., Quincy, Mass. 02169

[21] Appl. No.: 338,652

[22] Filed: Nov. 14, 1994

[51] Int. Cl.[6] ..... A63B 67/02

[52] U.S. Cl. ..... 273/176 H; 273/176 K

[58] Field of Search ..... 273/176 H, 176 K, 176 F, 273/176 FA, 176 FB, 179 C, 182 R, 182 A

[56] References Cited

U.S. PATENT DOCUMENTS

| | | | |
|---|---|---|---|
| 1,582,183 | 4/1926 | Maurer | 273/176 H |
| 1,897,289 | 2/1933 | Wieden | 273/176 F |
| 1,904,034 | 4/1933 | Walstrom | 273/176 H |
| 2,334,540 | 11/1943 | Buffham | 273/176 H |
| 3,620,536 | 11/1971 | Lau | 273/176 A |
| 3,826,501 | 7/1974 | Hiromachi | 273/176 A |
| 4,171,812 | 10/1979 | Marsin | 273/185 R |
| 4,240,637 | 12/1980 | Cross et al. | 273/176 H |
| 5,102,141 | 4/1992 | Jordan | 273/179 A X |
| 5,333,876 | 8/1994 | Goto | 273/176 H |

*Primary Examiner*—George J. Marlo
*Attorney, Agent, or Firm*—Steven G. Saunders

[57] ABSTRACT

A system and kit for golf putting is disclosed comprising a foot box adjacent to a pivotable putting platform supported by legs that are pivotally connected to the platform. The platform includes an upper surface defining a hole and is capable of returning balls via a pivoting function provided by the pivotal connection of the legs.

17 Claims, 3 Drawing Sheets

SYSTEM FOR GOLF PUTTING

FIELD OF THE INVENTION

This invention relates generally to a golf putting device, and more particularly concerns a golf putting device having a simplified ball return apparatus.

BACKGROUND OF INVENTION

A golfer must practice and perfect his putting skills in order to be a successful golfer. Accordingly, there are many known methods and devices utilized in the art that facilitate a golfer in practicing his putting. One of the more common practice methods is for the golfer to practice putting a relatively short distance from a hole on a golf green and to repetitively putt towards that hole. This method is not convenient to the golfer, however, in that it includes green fees, cannot be practiced during inclement weather, and requires the golfer to continually retrieve his putted golf balls.

Many of the known golf putting devices return a golf ball towards a putting location under the influence of gravity. Such devices typically require a user to putt a golf ball up an inclined surface where the ball is to be received through a hole and subsequently discharged through a chute. The potential energy of the golf ball at the height of the hole thus is converted into kinetic energy to return the ball towards the putting area. U.S. Pat. No. 4,240,637, to Cross et al., dated Dec. 23, 1980, discloses such a device. Specifically, a putting practice apparatus is disclosed that returns a golf ball by passing putted balls through a channel underneath the putting surface of the device. Such a device necessarily requires the user to engage in some physical manipulation of the device to return the balls, namely the displacement of an internal rod, as it does not return any balls to the putting surface. This device therefore is not convenient to use in that it does not allow the user to putt continually, nor does it allow the user to retain the same physical position while golf balls are being returned to the user.

It is also known in the art to utilize an electromechanical device to return putted balls to the user. U.S. Pat. No. 5,102,141 to Jordan, dated Apr. 7, 1992, discloses a golf putting practice device that returns balls to the user through a ramp structure. An electromechanical "kicker" that applies a striking force to the golf balls is placed at the far end of the ramp, thereby forcing the balls toward the user. The inclusion of the kicker in the putting device increases the device weight, thus reducing its effective portability. Such an apparatus furthermore requires a power supply which increases operating costs and limits the range of settings for the use of the device.

In addition to the prior noted limitations, neither of the prior noted devices discloses any type of apparatus that elevates the standing position of the user to the level of the putting surface. Such an elevation apparatus increases the realism of the putting as it can be adapted to serve other important functions.

Accordingly, there is a great need for a device that allows a user to continually and conveniently practice putting a series of golf balls towards a hole, where such a device returns the golf balls to the user in response to a subtle motion of the user.

SUMMARY OF INVENTION

It is therefore an object of this invention provide a golf putting device that does not require the user to continually retrieve putted golf balls.

It is another object of this invention to provide a golf putting device that allows the user to continually putt golf balls toward a hole without leaving the putting stance.

It is also an object of this invention to provide a golf putting device that simulates a realistic golfing surface.

It furthermore is an object of this invention to provide a golf putting device that returns putted golf balls in response to a subtle motion by the user.

It is still another object of this invention to provide a golf putting device and kit that is portable and simple to disassemble and assemble.

It a further object of this invention to provide a golf putting device that returns balls under the influence of gravity.

It is yet another object of this invention to provide a golf putting device that is simple to manufacture and use.

It is still a further object of this invention to provide a golf putting device that elevates the standing position of the user to the height of the putting surface.

This invention results from the realization that a golf putting apparatus having a pivotable putting surface enables a user to simply and efficiently retrieve a missed golf ball, thereby providing continuous putting from a fixed position(s).

The above and other objects are achieved in accordance with the present invention which, according to a first aspect, provides a system for golf putting comprising the combination of a foot box, a putting platform adjacent to the foot box, and a means for pivotally supporting the platform upon a flat surface. The foot box includes a plurality of box walls extending downwardly from a top surface to define a chamber, and a door pivotally in communication with the box walls. The platform includes an upper surface defining a first hole, a plurality of platform walls extending upwardly from the upper surface, where at least one platform wall defines a second hole, a member extending downwardly from a bottom side of the platform, and a ball guide disposed between the first hole and the second hole. The platform may also include a gutter upon the upper surface, a carpet disposed upon at least seventy-five percent of the upper surface, and a front end that is higher in height than a rear end. Such an embodiment further includes at least two legs for supporting means.

According to a second aspect of the invention, a system for golf putting is disclosed comprising a putting platform and a means for pivotally supporting the platform upon a surface. The platform includes an upper surface defining a first hole, a plurality of platform walls extending upwardly from the upper surface where at least one platform wall defines a second hole, a member extending downwardly from a bottom side of the platform, and a ball guide disposed between the first and second holes. A gutter and/or a carpet may be disposed upon the upper surface. A foot box further may be placed adjacent to the platform, where the foot box includes a plurality of box walls extending downwardly from a top surface to define a chamber, and a door pivotally in communication with the box walls.

According to a third aspect of the invention, a kit for golf putting is disclosed comprising a putting platform, a member adapted to be mounted upon a bottom side of the platform, and a means for pivotally supporting the platform that is adapted to be connected to a means for pivotally connecting a member upon the platform. The platform includes an upper surface defining a first hole, a plurality of platform walls extending upwardly from the upper surface where at least one platform wall defines a second hole, a ball guide disposed between the first and second hole, and the means for pivotally connecting a member. A foot box and a means for coupling the foot box to the platform may further be included.

DISCLOSURE OF PREFERRED EMBODIMENT

Other objects, features, and advantages of this invention will occur to those skilled in the art from the following description of a preferred embodiment and the accompanying drawings, in which:

Turning first to FIG. 1, there is shown a perspective view of golf putting system in accordance with a preferred embodiment of the present invention.

Figure 1:
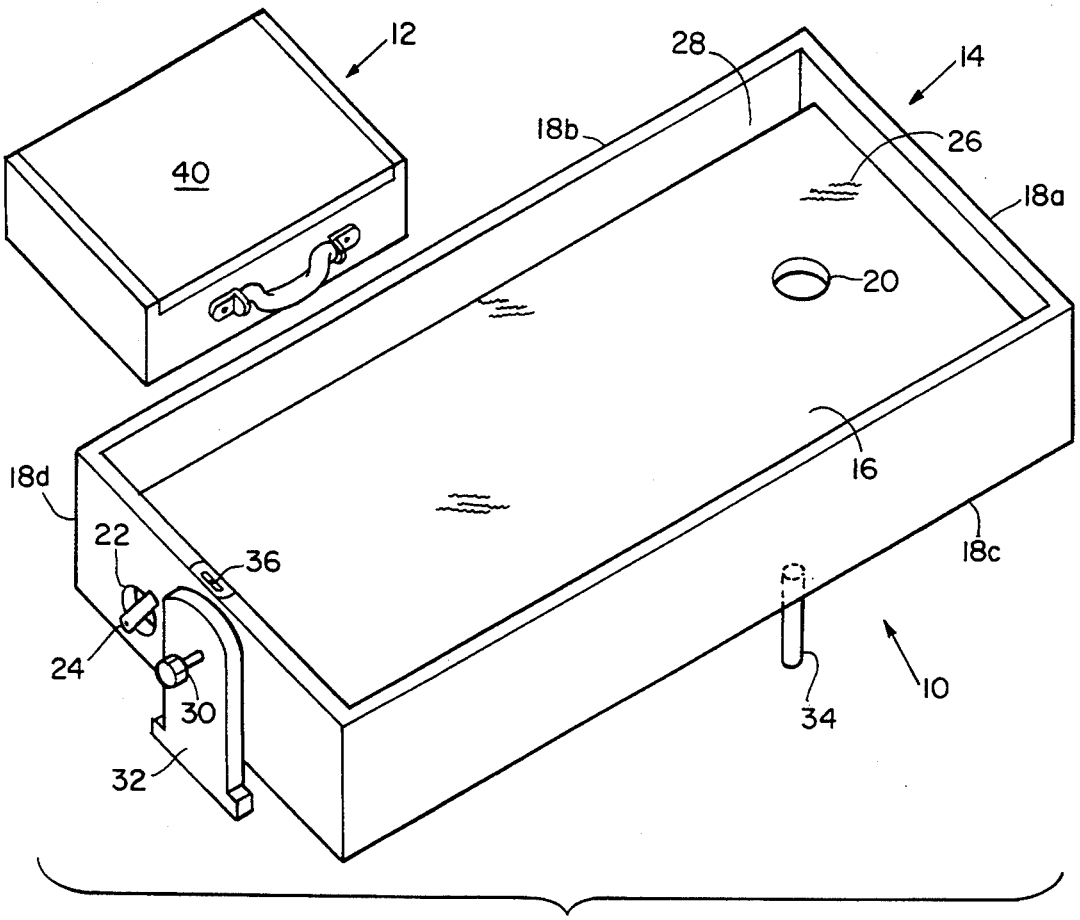
Figure 2:
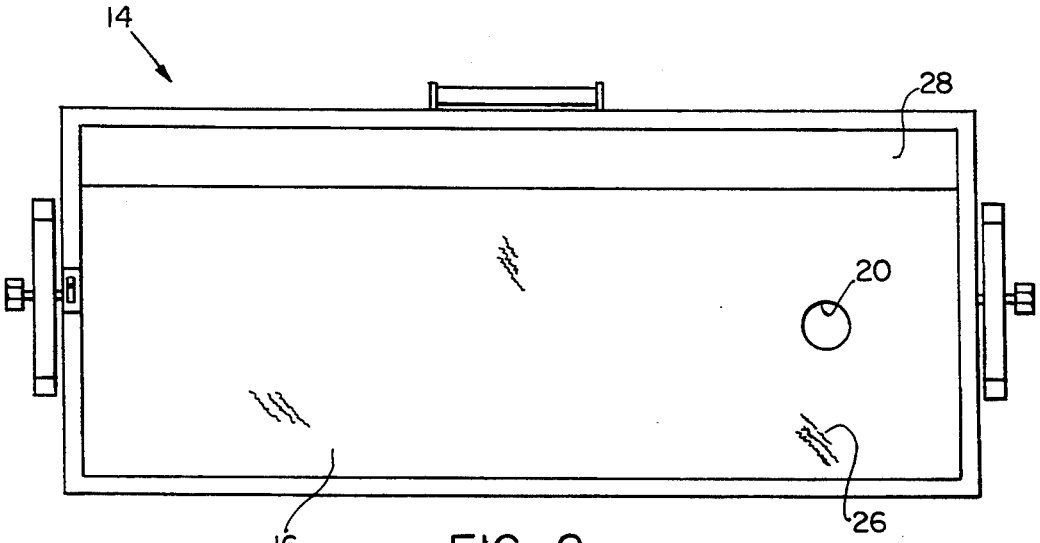
FIG. 2 shows a top view of the preferred embodiment of a putting platform in accordance with the present invention.
Figure 6:
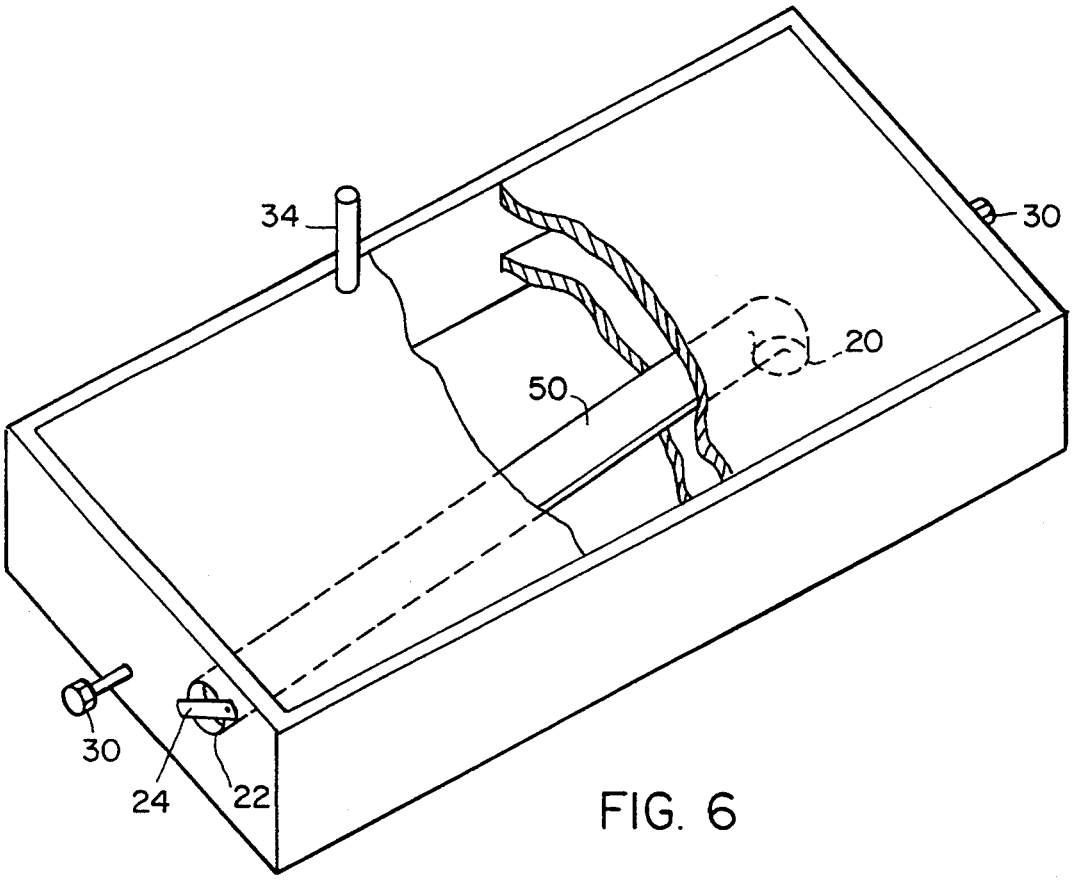
FIG. 6 shows an isometric perspective view of the bottom side of the putting platform of FIG. 2.

There is shown in FIG. 1 and FIG. 2 a preferred embodiment of golf putting system 10 having a foot box 12 and a putting platform 14. Platform 14 as generally illustrated includes an upper surface 16 and walls 18*a*, 18*b*, 18*c*, and 18*d* extending upwardly from upper surface 16. Walls 18*a*–18*d* serve to retain putted golf balls within upper surface 16 of platform 14. Upper surface 16 defines a first hole 20 that is the target hole for putted golf balls. Although any wall can define a second hole 22, the preferred embodiment as shown has wall 18*d* defining second hole 22 that receives putted balls from first hole 20 via a ball guide 50, as shown in FIG. 6. Ball stop 24 is affixed across second hole 22 to retain balls within second hole 22 for subsequent use. A carpet 26 is disposed upon a substantial portion of upper surface 16 to simulate actual putting greens, preferably upon at least seventy-five percent of its surface. Carpet 26 is preferably not covering the far left side of platform 16 so that missed golf balls will return to the user under the least frictional resistance.

In lieu of a mere carpetless left-side ball return area of upper surface 16, a gutter 28 as shown on the left side of platform 14 may further be utilized. Gutter 28 as shown has a front end that is higher in height than a rear end, thus turning potential energy into kinetic energy as missed golf balls return to the user at the front end of platform 14. An alternative embodiment has platform 14 at an upward angle. Specifically, such embodiment includes a platform 14 that has a front end that is higher in height than a rear end. Such an arrangement allows a user to practice uphill putting as it eliminates the necessity to have gutter 28 at an inclined angle. Gutter 28 is preferably a smooth material, such as wood, metal, or plastic to act as a reduced friction golf ball return.

An alternative embodiment of platform 14 has its front end lower in height than its rear end. Such an arrangement is utilized to simulate a downhill putt. In order for platform to properly return golf balls to the rear end, gutter 28 therefore must be included having a front end that is higher in height than its rear end. The resultant angle on the horizontal of gutter 28 necessarily must be greater than the angle of upper surface 16 on the horizontal.

Wall 18*d* includes a bolt 30 or other member for protruding perpendicularly from its surface to provide a means for pivotally supporting platform 14. A leg 32 is pivotally connected to bolt 30 which serves to pivotally support platform 14 at its rear end at wall 18*d*. A second bolt and leg are correspondingly pivotally connected to-wall 18*a* to identically support platform 14 at its front end. The corresponding bolts 30 create an effective axis across platform 14 for rotation on the horizontal. An alternative embodiment includes a support structure about a substantial portion of the periphery of platform 14 in place of legs 32. In such an embodiment, platform 14 is pivotally connected to the support structure, which is securely placed upon a flat surface.

A screw 34 or other member is mounted through wall 18*c* to prevent the rotation of platform 14 beyond a specific, predetermined angle. Screw 34 is adjustable in size to give platform 14 a plurality of angles of use. An alternative embodiment, however, has a member extending downwardly from wall 18*c*, or at any point between wall 18*c* and the center of platform 14, thus limiting such embodiment to a single angle.

A level 36 is mounted on wall 18*d* to give a visual indication of the angle of platform 14. Level 36 may be any digital, analog, or other conventional device known in the art for making immediate angle determinations.

Figure 3:
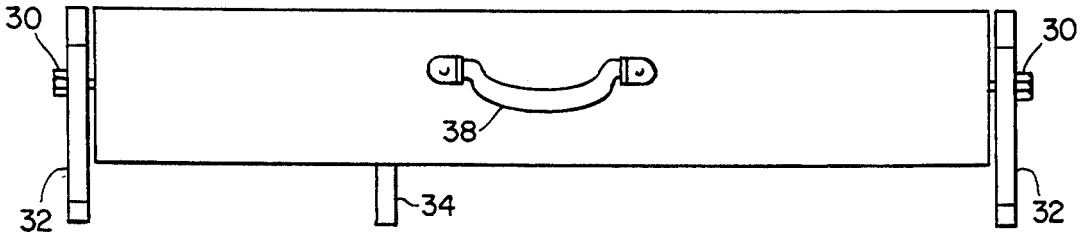
FIG. 3 shows a side view of the putting platform of FIG. 2.

FIG. 3 shows a side view of the preferred embodiment of platform 14. A handle. 38 is mounted upon wall 18*b*, thereby increasing the portability of putting system 10 and platform 14. Also shown are corresponding bolt 30 and leg 32 for walls 18*d* and wall 18*a* respectively.

Figure 4:
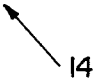
FIG. 4 shows a front view of the putting platform of FIG. 2.
Figure 4:
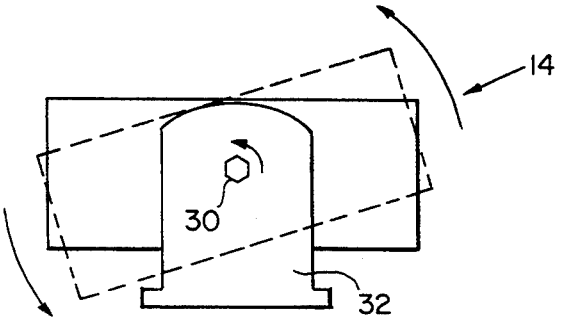

FIG. 4 shows a front view of the preferred embodiment of platform 14. Both walls 18*a* and 18*d* have identical arrangements for leg 32 and bolt 30. The dashed lines show the final position of platform 14 when in use.

Figure 5:
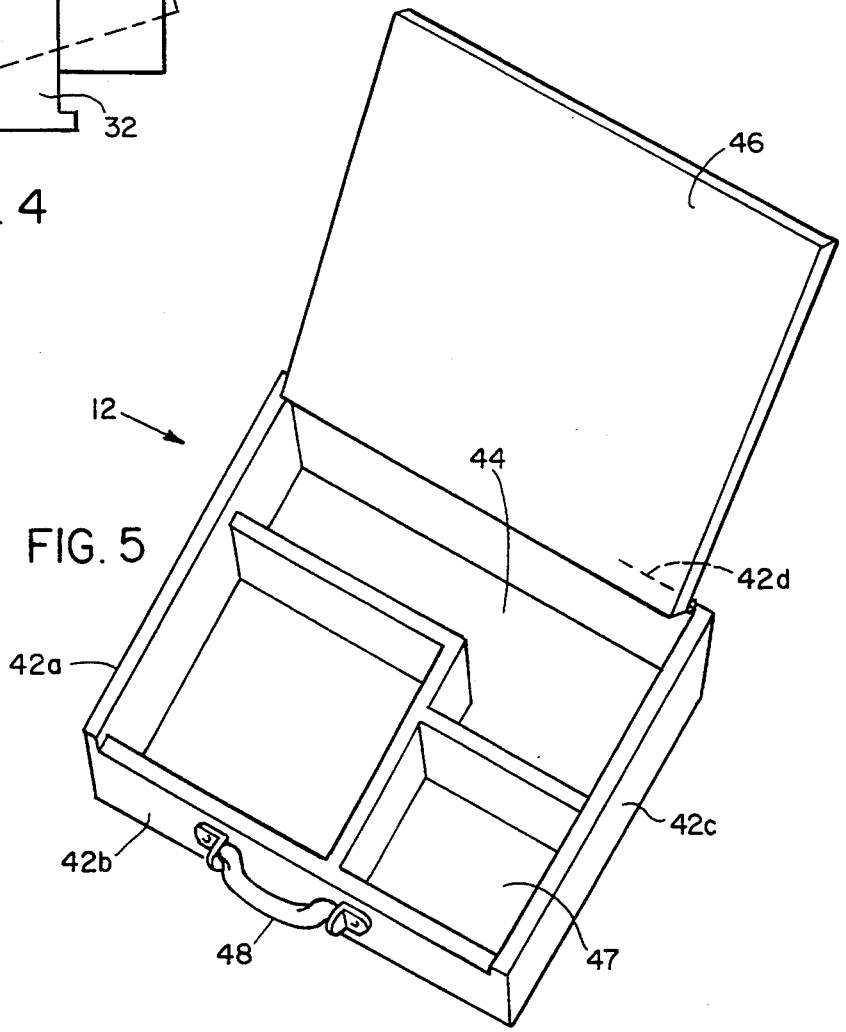
FIG. 5 shows a perspective bottom view of a foot box in accordance with the preferred embodiment of the present invention.

FIG. 5 shows a perspective bottom view of foot box 12 in accordance with the preferred embodiment of the present invention. Specifically, foot box 12 has a top surface 40 (see FIG. 1), a plurality of box walls 42*a*, 42*b*, 42*c*, and 42*d* extending downwardly from top surface 40 that define a chamber 44, and a door 46 pivotally in communication with two of the walls. Chamber 44 may be divided up into specific compartments 47 so that golf and other accessories may be stored therein. A strap, not shown, or other coupling means is utilized to couple foot box 12 to platform 14, thus further increasing the portability of golf putting system 10. A handle 48 further is connected to wall 42*b* for portability purposes.

FIG. 6 shows an isometric perspective view of the bottom side of the preferred embodiment of platform 14. Ball guide 50 is connected between first hole 20 and second hole 22 at a downward angle, thus utilizing gravity to force golf balls back towards the rear end of platform 14. First hole 20 may be in any convenient location on upper surface 14, as second hole 22 may similarly be at any of walls 18*a*–18*b*. Ball guide 50 preferably is a plastic tube of slightly larger diameter than a standard golf ball. Any type of hollow member or other ball guiding means known in the art, however, may be utilized in effectuating ball guide 50.

The elements of platform 14 may be arranged in any manner convenient in the art. Gutter 28 may be designed to run along wall 18*c* as screw 34 may correspondingly be disposed upon wall 18*b*, or at any point between the appropriate wall and the center of platform 14.

Operation and use of golf putting system 10 is quite simple. A user may first stand upon foot box 12 which is adjacent to platform 14. Such placement elevates the standing position of the user to the height of the putting surface, thereby giving a more realistic putting effect. One or more golf balls are then placed upon upper surface 16, and the user putts the golf balls toward first hole 20. When each of the balls have all been putted, the user gently pushes down upon one wall or end of platform 14, thereby rotating or tilting platform 14 to one side. This tilting action forces the missed golf balls to roll to the side, where they are contained by wall 18*b* and gutter 28. The inclined angle of gutter 28 or upper surface 16 then forces the golf balls toward the rear of platform 14 and back to the user for re-use. The user then simply positions the balls with his golf club for a subsequent set of putts. When each of the balls have been deposited into first hole 20, the user releases them through second hole 22 and repeats the above procedure.

The preferred embodiment of platform 14 is appropriately weighted to rotate in a clockwise direction immediately after it has been tilted counterclockwise for ball retrieval. An alternative embodiment includes a spring to automatically rotate platform 14 back to its original position.

Foot box 12 is not necessary in the use of golf putting system 10. A user may use platform 14 without standing on foot box 12. Furthermore, the angle of platform 14 may be adjusted by rotating screw 34. While rotating screw 34, the user watches level 36 to accurately set the angle to a desired pitch.

Golf putting system 10 further may be broken down into a kit, thus promoting portability. Specifically, screw 34 is adapted to be mounted upon one wall of platform 14 and legs 32 are adapted to be pivotally connected to platform 14. In the preferred kit embodiment, legs 32 and screw 34 are stored within chamber 44 of foot box 12 and a strap or other means for coupling foot box 12 to platform 14 is utilized.

Any conventional material known in the art may be utilized to manufacture golf putting system 10. The preferred embodiment is made of varnished wood, thus giving a more aesthetically pleasing effect. Wood increases the weight of system 10, however, as it further increases the cost of manufacture. An alternative embodiment is manufactured of plastic or other petroleum based compound through conventional injection molding processes. Such an embodiment yields a lighter, and thus more portable system 10, as it decreases the ultimate cost of manufacture. System 10 may also be manufactured with metal or other material known in the art. Carpet 26 may be any made of any conventional material, preferably a green indoor/outdoor plastic fibered carpet.

EXAMPLE I—STRUCTURE

Platform 14 is manufactured of varnished wood, has a length of 72 inches, a width of 19 inches, and a height of 5.5 inches. Carpet 26, which has a length of 72 inches and a width of 14 inches, covers upper surface 16 from rear wall 18*d* to front wall 18*a*, but does not cover gutter 28 which has exposed wood on its upper surface. Front end is 2 inches higher in height than rear end, and first hole 20, which is 2.5 inches in diameter, is defined by upper surface 16 69 inches from the rear wall 18*d*. Two legs 32 are pivotally and removably connected to platform 14 at the front and rear ends, respectively, and second hole, having a diameter of 2.5 inches, is defined by rear wall 18*d*. Ball guide 50 is a P.V.C.-type of tube having a diameter of 3 inches. A wood handle 38 is affixed to wall 18*c*. Foot box 12 is also made of varnished wood, has a carpet disposed upon its top surface 40, and has a length of 18 inches, a width of 15 inches and a height of 5.5 inches. Foot box 12 further includes a door 46 and a series of compartments 47 within chamber 44 to store legs 32, screw 34, golf balls, and other golfing items. A wood handle 48 is affixed to wall 42*b* for portability.

EXAMPLE II—USE OF PUTTING SYSTEM 10

Using golf putting system 10 of Example I, a user steps upon foot box 12 which is placed two inches from platform 14. Five golf balls are placed directly upon upper surface 16 and putted toward first hole 20. After the final putt, the user gently pushes down on the wall 18*b* of platform 14, which is opposite from side 18*c* that supports screw 34. Platform 14 accordingly tilts toward wall 18*b* as the missed golf balls roll toward gutter 28. After the balls have each reached gutter 28, the user ceases applying pressure to wall 18*b* thus returning platform 14 to its original position, and the balls each roll down toward the rear end. The user then re-putts those balls until each has been deposited into first hole 20. At such time, the user rotates ball stop 24 and the five balls each exit from second hole 22. The balls are then place down upon upper surface 16 and the above procedure is repeated.

Golf putting system 10 accomplishes each of the noted objects of the invention and solves many of the limitations existent in the prior art. Specifically, system 10 allows a user to continually putt without leaving the putting stance. System 10 is simple and easy to use, requires only a subtle motion to effectively utilize, and is suitable for indoor and/or outdoor use. System 10 furthermore is portable and available as a kit, thereby enhancing its convenience and simplicity. Operating costs are effectively nonexistent because no power supply is necessary. Regular use of system 10 by a golfer has the desirable effect of increasing such golfer's skill level, thereby reducing the final golf score.

Although specific features of this invention are shown in some drawings and not others, this is for convenience only as some features may be combined with any or all of the other features in accordance with this invention.

The foregoing is considered as illustrative only of the principles of the invention. Furthermore, since numerous modifications and changes will readily occur to those skilled in the art, it is not desired that the foregoing limit the invention to the exact construction and operation shown and described. Accordingly, all suitable modifications and equivalents may be resorted to that appropriately fall within the scope of the invention. Other embodiments therefore will occur to those skilled in the art and are within the scope of following claims.

I claim:

1. A system for golf putting, comprising in combination:

a foot box comprising a plurality of box walls extending downwardly from a top surface, said box walls defining a chamber, and a door pivotally in communication with said box walls;

a putting platform adjacent to said foot box, said platform comprising an upper surface defining a first hole, a plurality of platform walls extending upwardly from said upper surface, at least one platform wall defining a second hole, a ball return guide disposed between said first hole and said second hole;

means for supporting said platform for pivotal movement about a horizontal axis; and a member extending downward from a bottom side of said platform to prevent pivotal movement of said platform beyond a predetermined angle.

2. The system for golf putting of claim 1, in which said foot box further includes a plurality of compartments disposed within said chamber.

3. The system for golf putting of claim 1, in which said platform further includes a gutter disposed upon said upper surface.

4. The system for golf putting of claim 3, in which said gutter has a front end and a rear end, said front end higher in height than said rear end.

5. The system for golf putting of claim 3, further including a carpet disposed upon at least seventy-five percent of said platform upper surface.

6. The system for golf putting of claim 3, further including a means for displaying the angle of said platform.

7. The system for golf putting of claim 6, further including a handle disposed upon at least one platform wall.

8. The system for golf putting of claim 1, in which said platform upper surface includes a front end and a rear end, said front end higher in height than said rear end.

9. The system for golf putting of claim 1, in which said means for supporting said platform includes at least two legs.

10. The system for golf putting of claim 1, in which said member includes a screw in communication with at least one platform wall.

11. The system for golf putting of claim 1, in which said first hole is higher in height than said second hole and said ball guide includes a tube mounted therebetween.

12. A system for golf putting, comprising:

a putting platform having an upper surface defining a first hole, a plurality of platform walls extending upwardly from said upper surface wherein at least one platform wall defines a second hole, a ball return guide disposed between said first hole and said second hole;

means for supporting said platform for pivotal movement about a horizontal axis; and a member extending downward from a bottom side of said platform to prevent pivotal movement of said platform beyond a predetermined angle.

13. The system for golf putting of claim 12, further including a gutter disposed upon said upper surface.

14. The system for golf putting of claim 13, in which said platform includes a front end and a rear end, said front end higher in height than said rear end.

15. The system for golf putting of claim 14, further including a carpet disposed upon at least seventy-five percent of said platform upper surface.

16. The system for golf putting of claim 15, further including a means for displaying the angle of said platform.

17. The system for golf putting of claim 16, further including a foot box adapted to be positioned adjacent to said platform, said foot box comprising a plurality of box walls extending downwardly from a top surface, said box walls defining a chamber, and a door pivotally in communication with said box walls.

* * * * *